US006125560A

United States Patent [19]

Beaumont

[11] Patent Number: 6,125,560

[45] Date of Patent: Oct. 3, 2000

[54] DREDGING APPARATUS

[76] Inventor: Robert Walter D Beaumont, Chantlers, Ewhurst Green, United Kingdom

[21] Appl. No.: 09/142,036

[22] PCT Filed: Feb. 27, 1997

[86] PCT No.: PCT/GB97/00553

§ 371 Date: Nov. 2, 1998

§ 102(e) Date: Nov. 2, 1998

[87] PCT Pub. No.: WO97/32091

PCT Pub. Date: Sep. 4, 1997

[30] Foreign Application Priority Data

Mar. 1, 1996 [GB] United Kingdom ..... 9604451

[51] Int. Cl.[7] ..... E02F 3/00; B63B 21/50

[52] U.S. Cl. ..... 37/344; 37/342; 37/307; 37/345

[58] Field of Search ..... 37/307, 316, 341, 37/342, 345, 344

[56] References Cited

U.S. PATENT DOCUMENTS

| | | | |
|---|---|---|---|
| 1,583,132 | 5/1926 | Falley | 37/342 |
| 2,662,310 | 12/1953 | Villota | 37/342 |
| 3,440,743 | 4/1969 | Divine | 37/342 |
| 4,073,078 | 2/1978 | Leitz | 37/77 |
| 4,267,652 | 5/1981 | Senesac | 37/66 |
| 4,445,290 | 5/1984 | Oules | 37/66 |
| 4,896,445 | 1/1990 | Deal | 37/195 |
| 5,027,533 | 7/1991 | Holt et al. | 37/55 |
| 5,249,378 | 10/1993 | Frame | 37/342 |
| 5,406,725 | 4/1995 | Breese | 37/342 |

FOREIGN PATENT DOCUMENTS

| | | |
|---|---|---|
| 0328198 | 8/1989 | European Pat. Off. . |

*Primary Examiner*—Eileen D. Lillis
*Assistant Examiner*—Gary S. Hartmann
*Attorney, Agent, or Firm*—Dowel & Dowel, P.C.

[57] ABSTRACT

A dredging apparatus comprising a body mounting thruster to direct, in use, a wash of water downwards towards an area of sea bed or the like, connection device to connect the dredging apparatus to a support vessel above the sea bed, said connection device including attitude adjusted to selectively adjust the attitude of the dredging apparatus in a side to side (roll) orientation.

6 Claims, 9 Drawing Sheets

DREDGING APPARATUS

BACKGROUND OF THE INVENTION

1. Field of the Invention

This invention relates to dredgers for removing sand, silt and like material from the river or sea bed and has application, for example to clearing wrecks, and providing trenches in which, for example, pipelines may be laid.

2. Description of the Related Art

A suction dredger is the most widely used apparatus for removing such material, suction being created by a motor and pump unit, somewhat like a vacuum cleaner. However, if used for clearing wrecks, such apparatus has the disadvantage that small and/or lightweight articles from the wreck can also be lifted and, even if a screen is provided in the suction path, the articles may be small enough to pass through the screen, or be difficult to extract from the other debris lifted.

A modified form of the suction method, which is used in tidal waters, is to provide a vertical length of pipe above the area to be cleared near the lower end of which air is fed under pressure to pass upwardly through said pipe. This creates a vacuum, which will act to lift the sand, silt and like material and set it in suspension with the water, whereafter it may be carried away from the area by the tide. This method is reliable in reducing the possibility of small/lightweight articles being lost, but is time consuming due to the relatively small diameter of the pipe, normally around 0.5 metres, and hence restricted area covered.

Another method, which can be used in relatively shallow tidal waters, e.g. up to about 10 metres in depth, comprises mooring a tug, ship or other vessel in a fixed position above the area to be cleared and deflecting the propeller wash downwardly using a suitable guide plate. The wash disturbs the material around the wreck, which material is thereby lifted, set in suspension and carried away from the area by the tide. Apart from the shallow depth, another restriction of this method is that, for a large wreck, the position of the vessel must be changed progressively to cover the complete area of the wreck, which is difficult and time consuming.

EP-A-328 198 disclose a method of dredging in flowing water comprising lowering a casing of a wing shape downwardly towards the area to be cleared, the casing carrying thrust means arranged so that the thrust means is directed downwardly, the orientation of the wing casing being adjusted in the water so that it presents a surface relative to the flow which causes a resultant downward vertical component of force to counteract the upward force provided by the thrust means, the thrust means directing a wash of water towards the areas to be cleared so that the turbulence created clears the sand, silt or like material covering the area.

This method of dredging is particularly useful for providing a trench across the sea bed. The wing shape casing is slowly towed along a line above the sea bed and the thrust means, which is directed vertically downwards, excavates a trench in the sea bed of a width which depends upon the material of the sea bed, its altitude above the sea bed, the power in the thrusters, its speed over the sea bed, and its pitch angle. In a typical example, the width of trench formed will be of the same order as the width of the wing shape casing.

Such a dredger, which is commonly known as a "wing dredger" has been successful in producing a trench of a width sufficient to take a pipeline or, alternatively, to flatten an area of sea bed in preparation for works on the sea bed.

However, its usefulness could be increased if it could, on occasions, provide a trench or clear an area of the sea bed of a greater width. This would allow a single wing dredger to be used in a wider variety of circumstances or alternatively a smaller wing dredger to be used to provide a trench of a particular width.

One's initial view might be that increasing the thrust with accompanying changes in pitch angle, or even the addition of ballast weights to the wing would provide a wider trench but in practice this would simply provide a deeper trench. Also an increase in thrust may mean that the wing has to be larger so as to counter-balance the upward reaction of the downward thrust.

A second proposal would be to increase the size of the wing dredger and provide more thrust means. This would provide a more unwieldy and more expensive wing dredger. This is undesirable for the limited additional use that such a wing dredger would have for providing trenches of greater than normal width, and also because the wing dredger has to be transported, typically over land, between assignments. A known wing dredger already requires three lorries to move the various sections, and, for example, doubling in size would require six lorries to carry out the same transportation with attendant increased cost.

SUMMARY OF THE INVENTION

We will describe a wing dredger which may be used to provide a trench of approximately double the normal width.

In principle, the arrangement is such that the wing dredger is modified so as to provide the possibility that the dredger can be disposed at a variable selectable roll angle (ie it may be mounted at angles other than horizontal from side-to-side). In this way the wing dredger can be passed over the line of the trench twice which will provide a double width trench. The thrust means will be at an angle to the line of the trench, so that the silt is blown first to one side of the trench and then on the second pass to the opposite side of the trench.

The present invention provides, according to one aspect, a dredging apparatus comprising a body mounting thrust means to direct, in use, a wash of water downwards towards an area of sea bed or the like, connection means to connect said dredging apparatus to a support means above the sea bed, normally a support vessel floating on the water's surface, characterized in that said connection means included attitude adjusting means to selectively adjust the attitude of the dredging apparatus in a side to side (roll) orientation. Preferably said attitude adjusting means is controllable to selectively adjust the attitude of the dredging apparatus independently in a front to rear (pitch) as well as the side to side (roll) orientation.

Said attitude adjustable means may comprise at least three points on said body connected by flexible means to said support means, means being provided to independently vary the distance between the support means and each said point.

BRIEF DESCRIPTION OF THE DRAWINGS

Preferred embodiments of the invention will now be described by way of example only and with reference to the accompanying drawings in which.

DESCRIPTION OF THE PREFERRED EMBODIMENT

Figure 1:
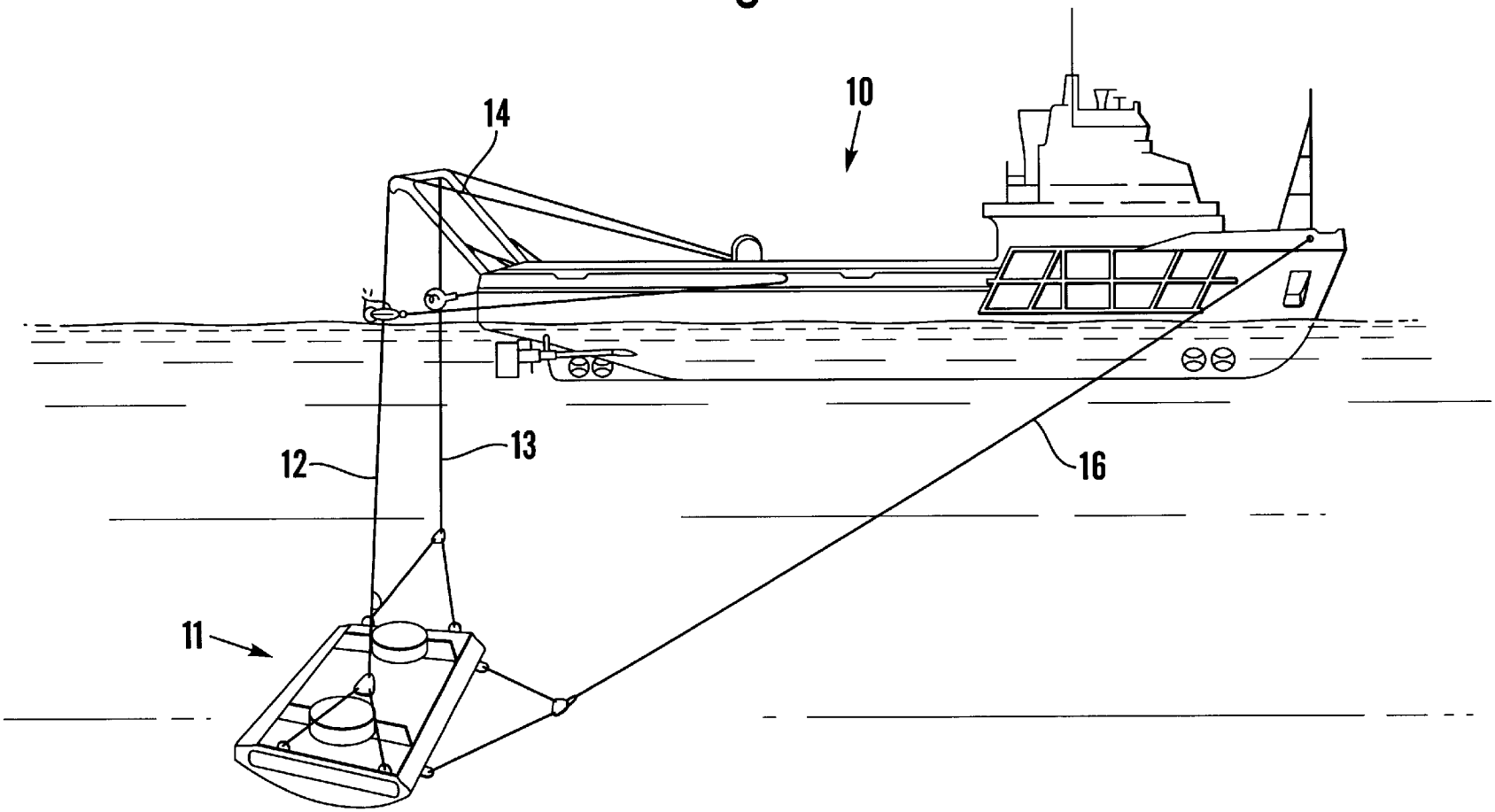
FIG. 1 is a diagrammatic view of a dredging apparatus in the form of a so called "wing dredger" in operation with its associated support vessel.

Referring to FIG. 1, a support vessel or mother vessel 10 is shown moving forward or stationary heading into a tidal flow. The tidal flow may be in a river, estuary, or at sea. To facilitate this operation, the area to be covered can be buoyed along each side, or perhaps in channels if a wide area is involved, to provide guide tracks for the vessel. Alternatively if the dredging operation is to be carried out over a small area, the support vessel can be stationed over the area by a four point mooring, or it can be dynamically positioned and the position controlled by eg satellites. A wing dredger 11 is suspended at an appropriate distance from the sea bed via a pair of cables 12, 13, one cable extending from each side of a lifting means 14 on the mother vessel 10 and there is provided a further cable 16 from adjacent the bow of the vessel 10.

Figure 2:
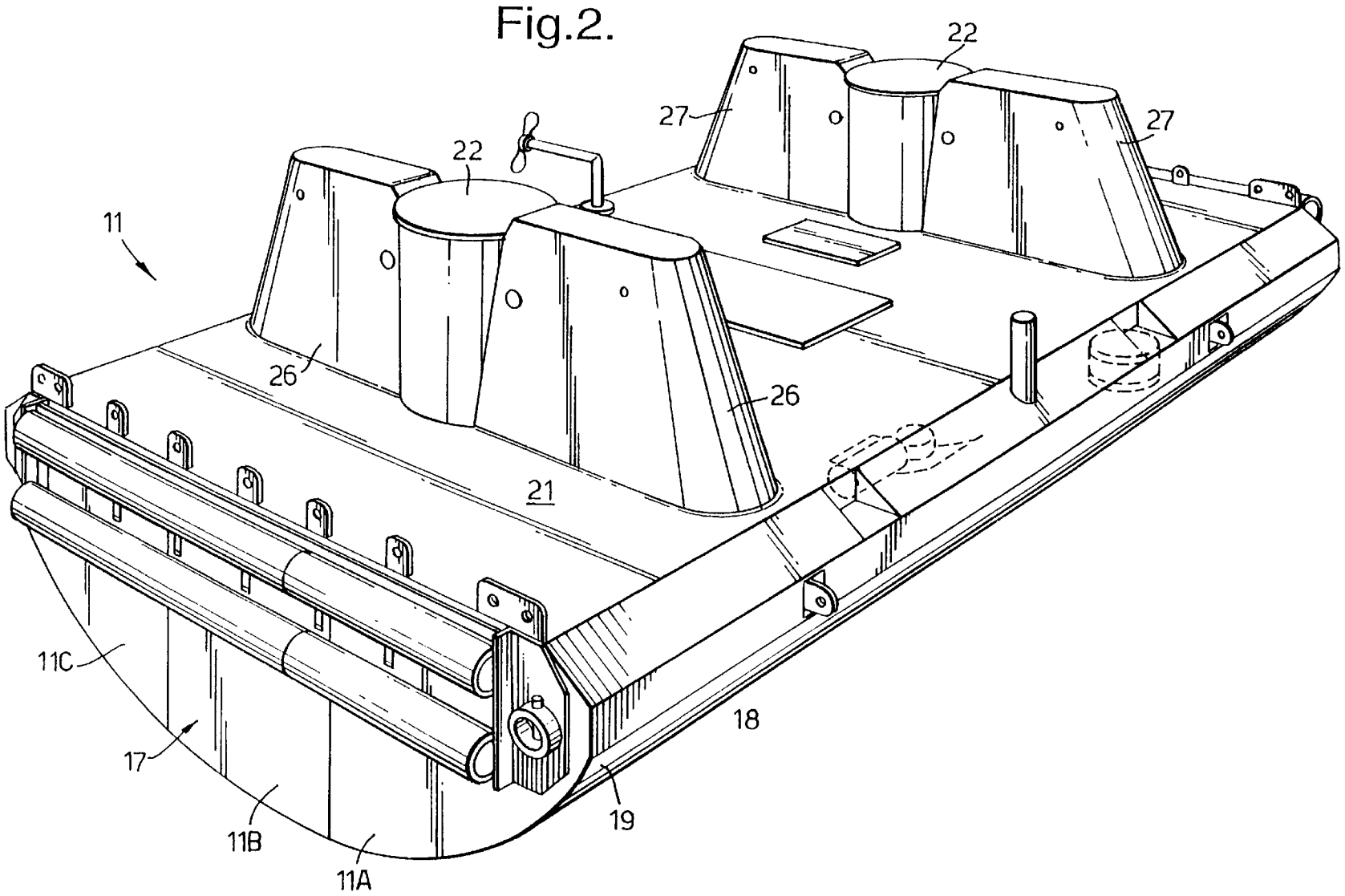
FIG. 2 is a perspective view of the wing dredger of FIG. 1.
Figure 3:
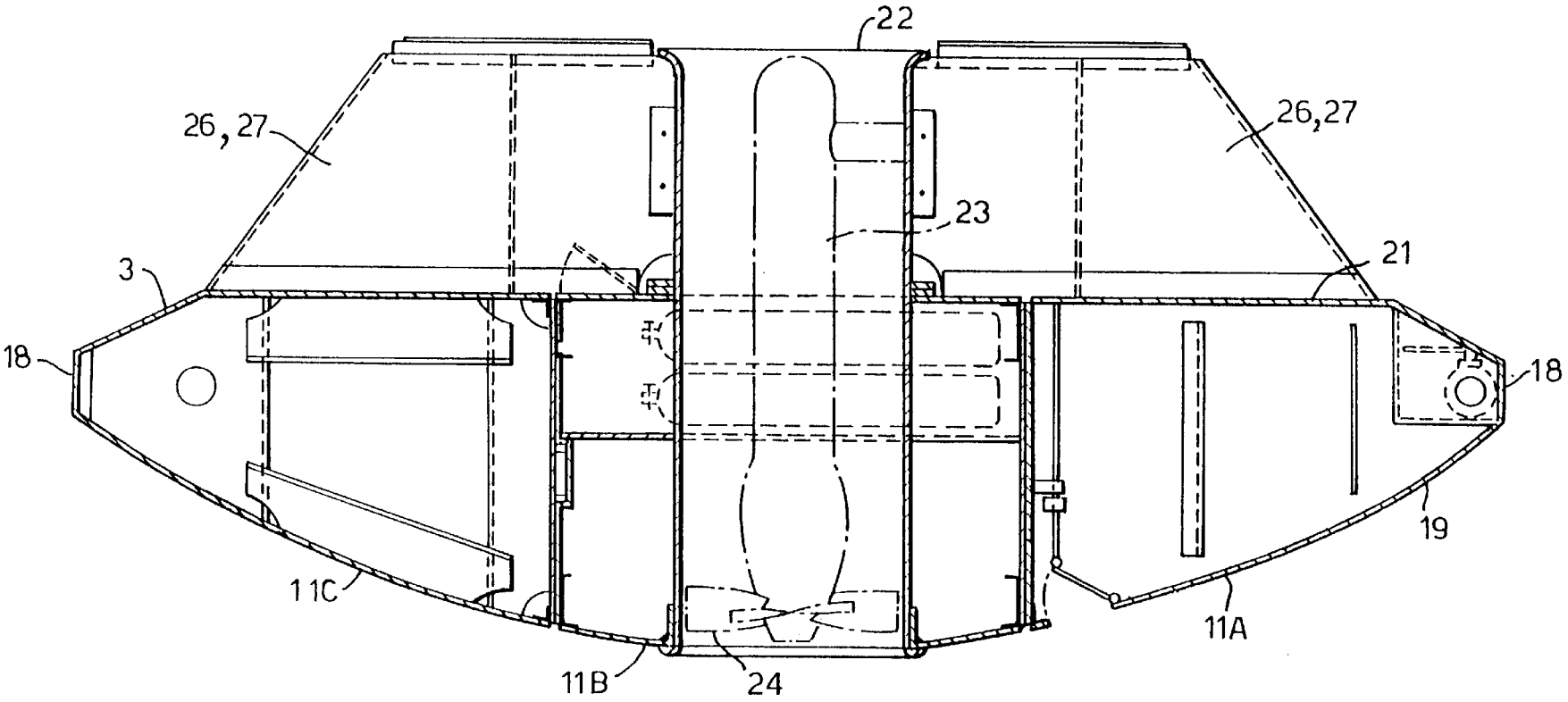
FIG. 3 is a cross section through the wing dredger of FIG. 2.

As illustrated in FIG. 2, the wing dredger has a hydrofoil cross section and is rectangular in plan. It is constructed as a casing comprising vertical end walls 17, connected by laterally extending wall 18, which provide lower angled faces 19 to provide a downward component of force when acted on by tidal flow providing as stability. The upper wall 21 is generally flat. Referring to FIG. 3, it will seen that the wing dredger 11 is constructed of three units, a front unit 11A, and mid-unit 11B and a rear unit 11C connected together, so that the wing dredger can be split into three sections for ease of transportation.

Each of the three units 11A, 11B and 11C are of steel skin construction and units 11A and 11C are hollow closed boxes. The hollow closed boxes are divided into compartments by suitable bulkheads.

It will be seen from FIG. 3 that the wing dredger is symmetrical about its lateral axis so that it can be used in either direction with the respective end wall 18 leading. The dredger 11 is provided with two closed vertical bores 22 which are laterally spaced from each other, each housing a thrust means 23 in the form of a motor driven propeller 24 mounted substantially in the plane of the wing 11 and the two propellers are driven in opposition to reduce the effects of centrifugalicentripetal forces. Where the two contra-rotating vertical jet vortices meet, very high forces are created which increase seabed penetration.

Upwardly extending. from the upper wall 21 are a pair of fins 26 and 27 each extending from adjacent the front edge to adjacent the rear edge. Each closed vertical bore 22 extends up through a respective fin 26,27. The propellers are driven by respective electric motors.

In use, a downward vertical component of force is provided by the leading angled face 19 when acted on by the tide, and/or forward speed of the vessel, which component can be increased by adjustment of the cables to tilt the casing, and hence the upper wall 21 thereof appropriately to the horizontal.

In a practical construction capable of operating down to a depth of approximately 45 metres of water, the wing dredger has dimensions of the order of 9000 mm×6000 mm. With a wing dredger of such size tilted 15 degrees from the horizontal, a resultant hydro-dynamic downward vertical component of force of up to about 9.5 tonnes is generated when the wing is being towed at 2 ½ knots (4.6 km/hr) relative to the water and 12.5 tonnes at 4 ½ knots (8.3 km/hr). To counter the weight and force components the propellers are designed to produce a thrust of between 0.5 and 5 tonne each.

Figure 4:
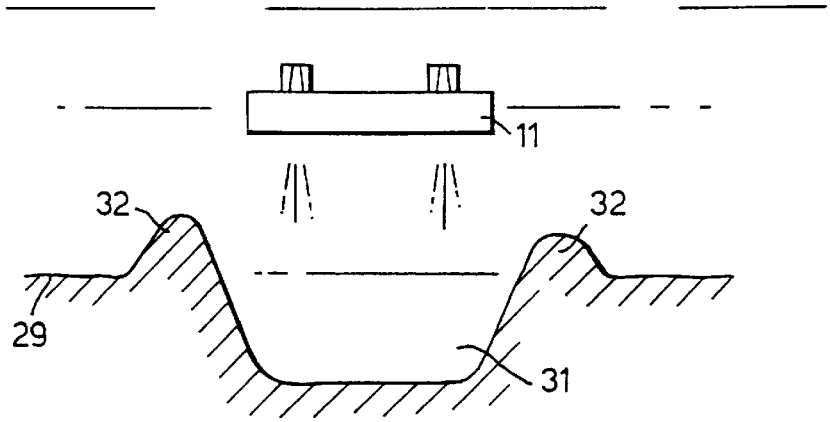
FIG. 4 is a diagrammatic front view of a wing dredger of FIG. 1. In normal orientation and use.

Referring to FIG. 4, there is shown in a very diagrammatic form a front view of a wing dredger as above described passing at a metre or two above the sea bed 29 and as a result of the downward thrust of the propellers 24, there is produced a trench 31 in the sea bed 29. At least some of the material which has been dislodged from the sea bed to produce the trench 31 is deposited on each side of the trench 31 to form a ridge 32.

Figure 5A:
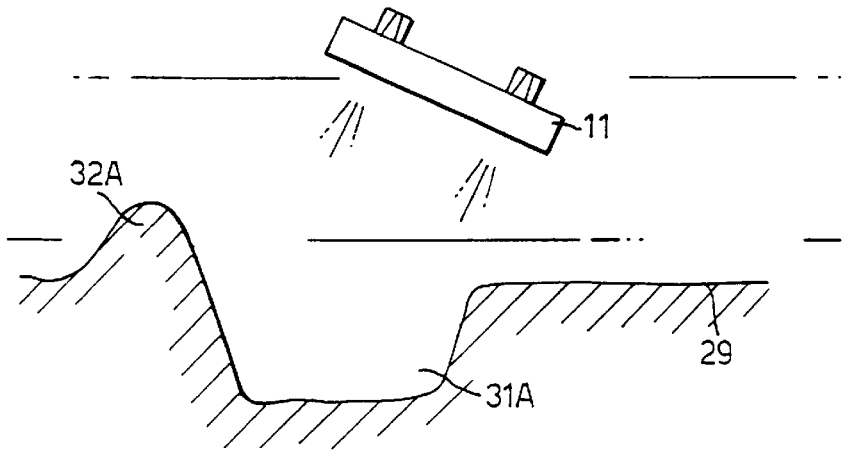
FIGS. 5A and 5B show views similar to FIG. 4 of the wing dredger of the invention in different orientations providing a trench of substantially twice the width of that provided in FIG. 4.
Figure 5B:
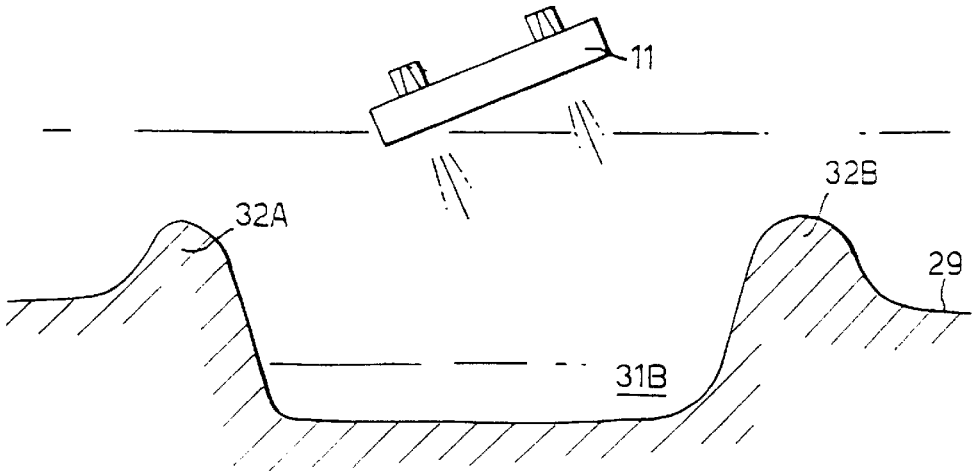

In essence we provide a wing dredger in which instead of the side to side attitude of the wing dredger being horizontal as shown in FIG. 4, means may be provided whereby the lateral axis of the wing dredger may be disposed at an angle to the horizontal. This angle is referred to as the roll angle. Thus, in FIG. 5A in which the wing dredger is provided at a roll angle other than horizontal, the wing dredger may then provide a trench 31A of the configuration shown in which the material from the trench, some of which is deposited on the side of the trench, is deposited so as to form a single ridge 32A on one side of the trench 31A, and at a second passing shown in FIG. 5B, with the wing dredger 11 at an opposite attitude or opposite roll angle, the trench 31A can be widened so as to provide a trench 31B of approximately double the width of the trench 31A and the material which is deposited on the second passing of the wing dredger over the trench, is deposited in a ridge 32B on the opposite side to the ridge 32A.

We will now describe means whereby the roll angle of the wing dredger 11 can be changed. We now refer to FIG. 6 which shows in schematic form the means for mounting the wing dredger. The cables 12, 13, terminate at their lower end in a pair of rings 41, 42 each ring being connected by a respective cable 43, 44, 46, 47 to fore and aft points 48–51 on the lateral side walls of the wing dredger 11. Ring 41 is connected by cable 43 to the aft point of one side wall and by cable 44 to the fore point of the same side wall and ring 42 is connected by cable 46 to the aft point of the other side wall and by cable 47 to the fore point of the same side wall.

The fore and aft points 48–51 are actually provided by respective winches 52–55 the motors for which are mounted inside the wing dredger. Each winch 52–55 may be separately controlled.

Figure 8A:
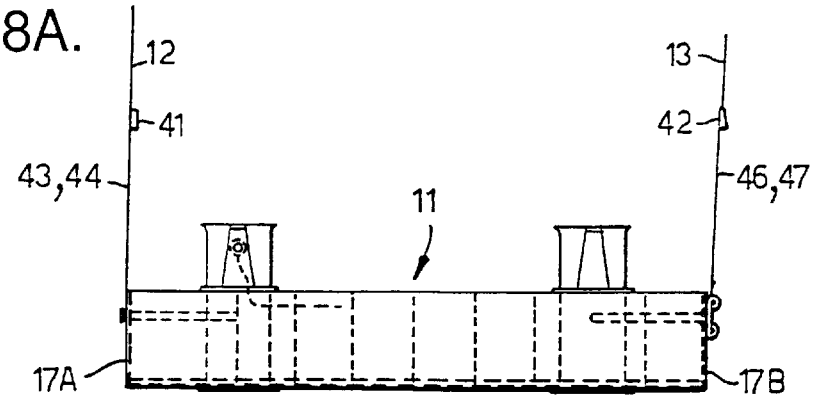
Figure 8B:
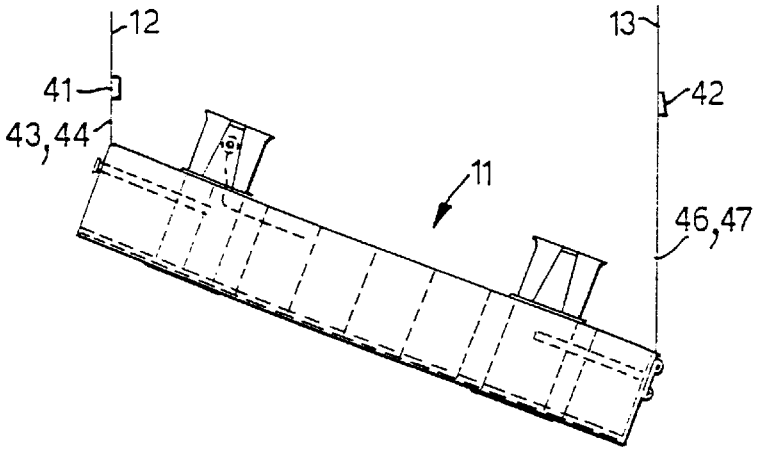

It would be understood, therefore, that the side—side attitude (roll angle) of the wing dredger may be adjusted by suitably operating the winches 52–55. For example, if it is desired to lift the end wall 17A with respect to the opposite end wall 17B, then the winches 52, 53 may be operated to wind in the cable 43, 44, thereby shortening their effective length and lifting that end wall 17A. Alternatively, the winches 54, 55 may be operated so as to unwind the cables 46, 47 to lengthen them or there may be a combination of shortening of cables 43, 44 and lengthening of cables 46, 47 (as in FIG. 8B) as desired.

Figure 8C:
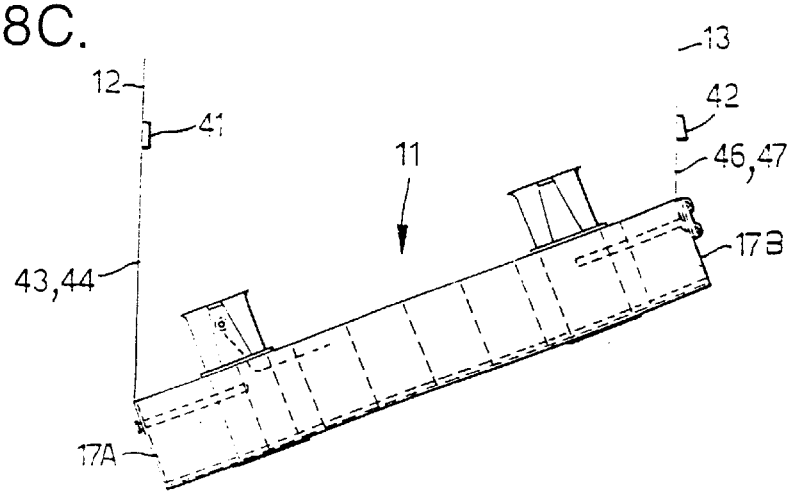

Similarly, to lift the end wall 17B with respect to end wall 1.7A (see FIG. 8C), the winches will be operated in the opposite manner to shorten cables 46, 47, and/or lengthen cables 43, 44.

Figure 6:
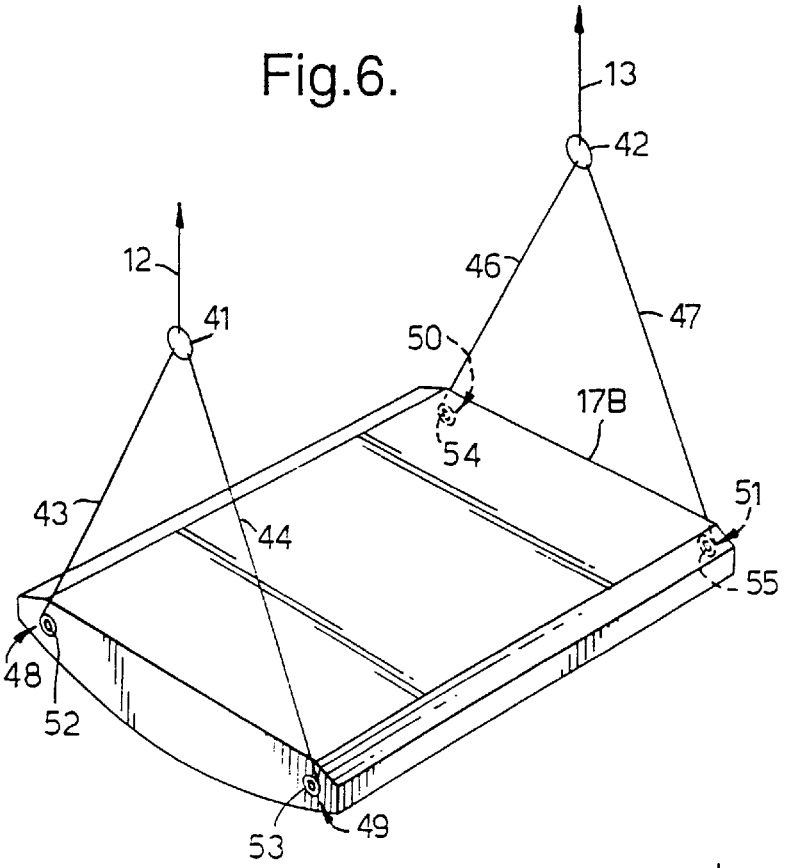
FIG. 6 shows one embodiment of attitude adjustable means in a wing dredger according to the invention.
Figure 7A:
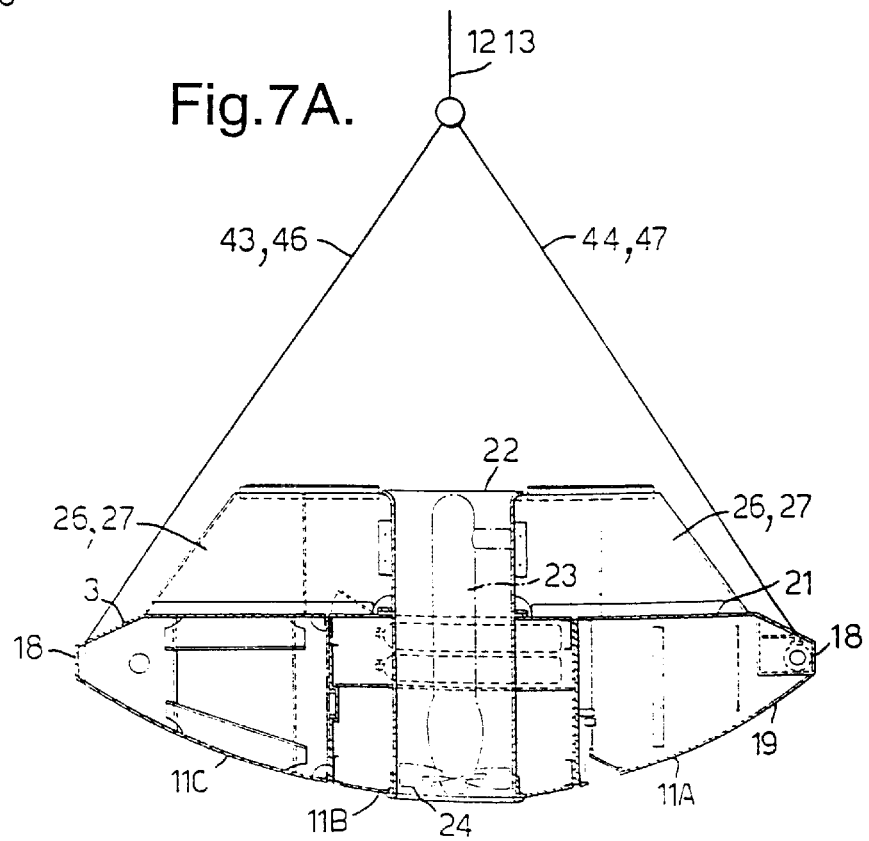
FIGS. 7A–7C show side views and FIGS. 8A–8C show front views of the wing dredger in different selected attitudes.
Figure 7B:
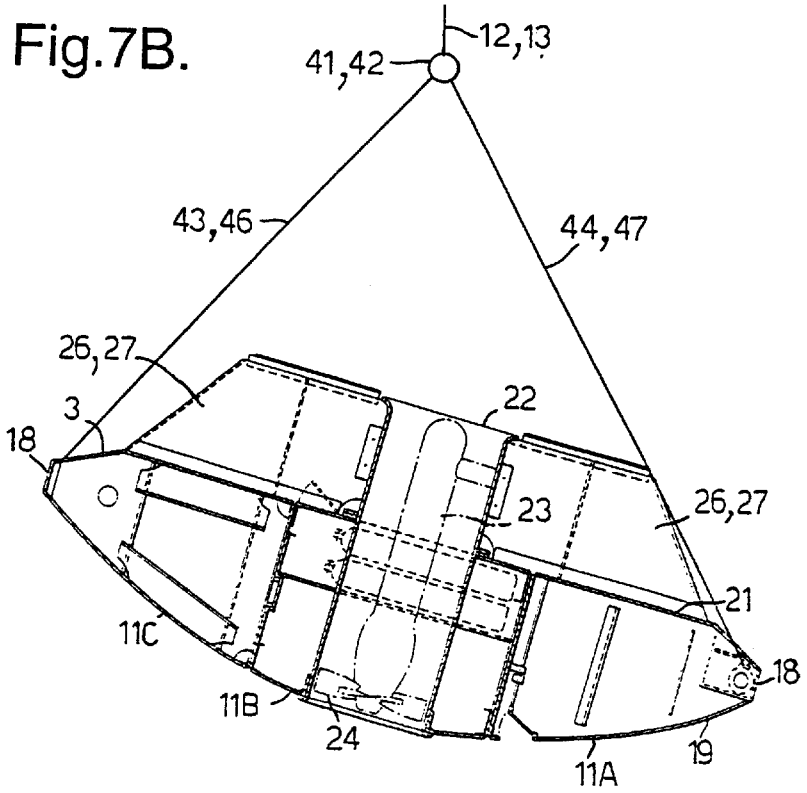
Figure 7C:
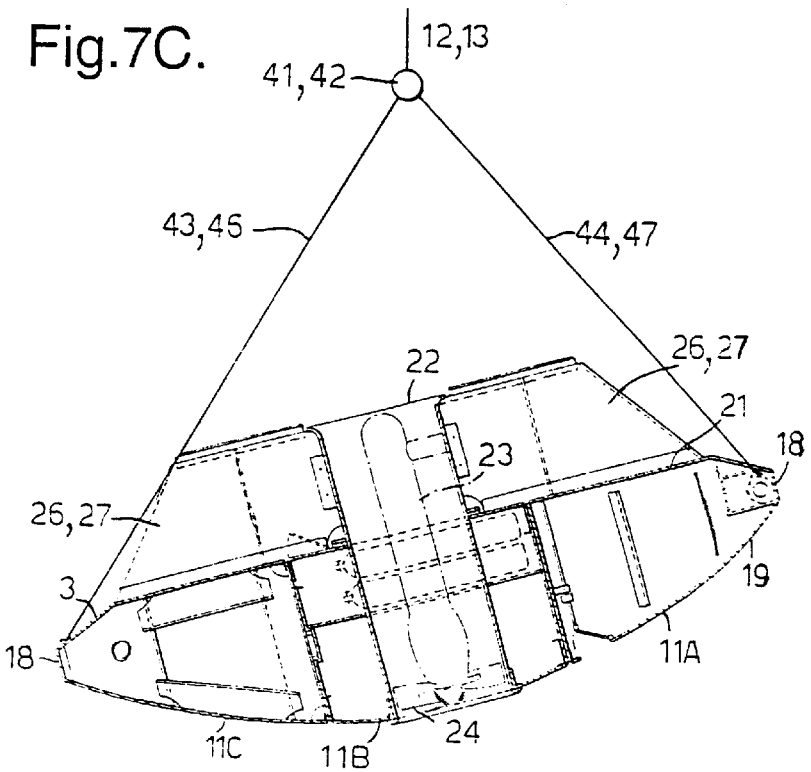

It will also be observed that using the arrangement described in FIG. 6, it is possible change the attitude of the wing dredger 11 in the fore and aft direction, that is the pitch angle to an extent independently of changes of length of the cable 16. Thus, if is desired to lower the front edge of the wing dredger, then the winches 51, 53 may be operated to unwind the cables 44, 47 and thereby lengthen them and/or the winches 52, 54 may be operated to wind in the cables 43, 46 to shorten them (see FIG. 7B). Operation of the winches in the opposite manner will raise the front of the wing dredger with respect to the rear, see FIG. 7C.

Other ways of changing the roll angle of the wing dredger may be provided. For example, it may be sufficient to replace winches 52, 53 by a single central winch on which both cables 43, 44 are mounted, winding in both cables simultaneously to lift that end wall 17A, and a similar arrangement being provided with respect to the opposite side of the wing dredger. On the other hand, such an arrangement would not allow one to adjust the pitch of the wing dredger.

Figure 9:
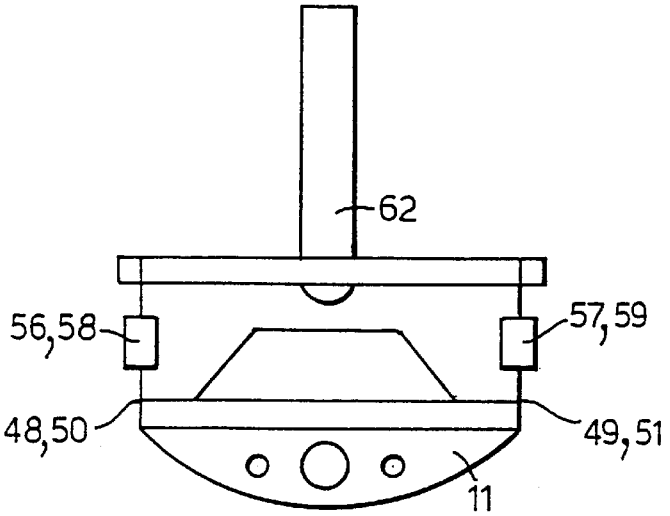
FIGS. 9 and 10 show side and plan views respectively of an alternative arrangement of wing dredger.
Figure 10:
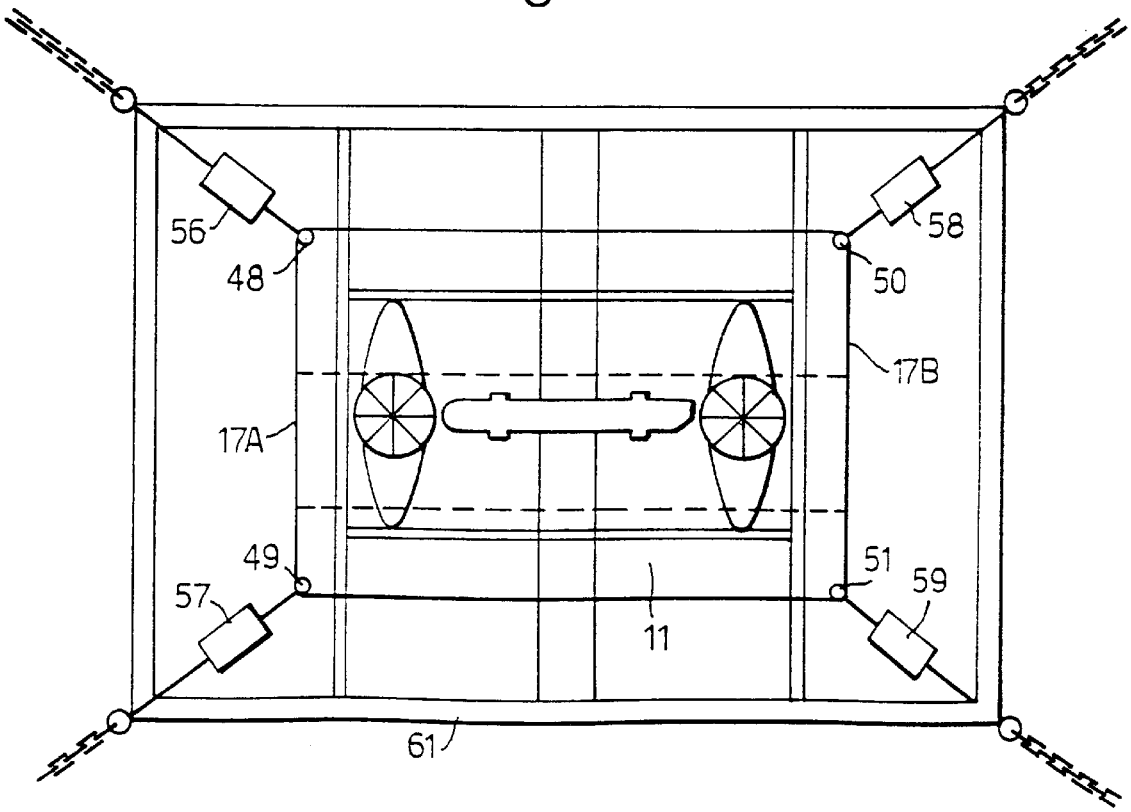
Figure 11:
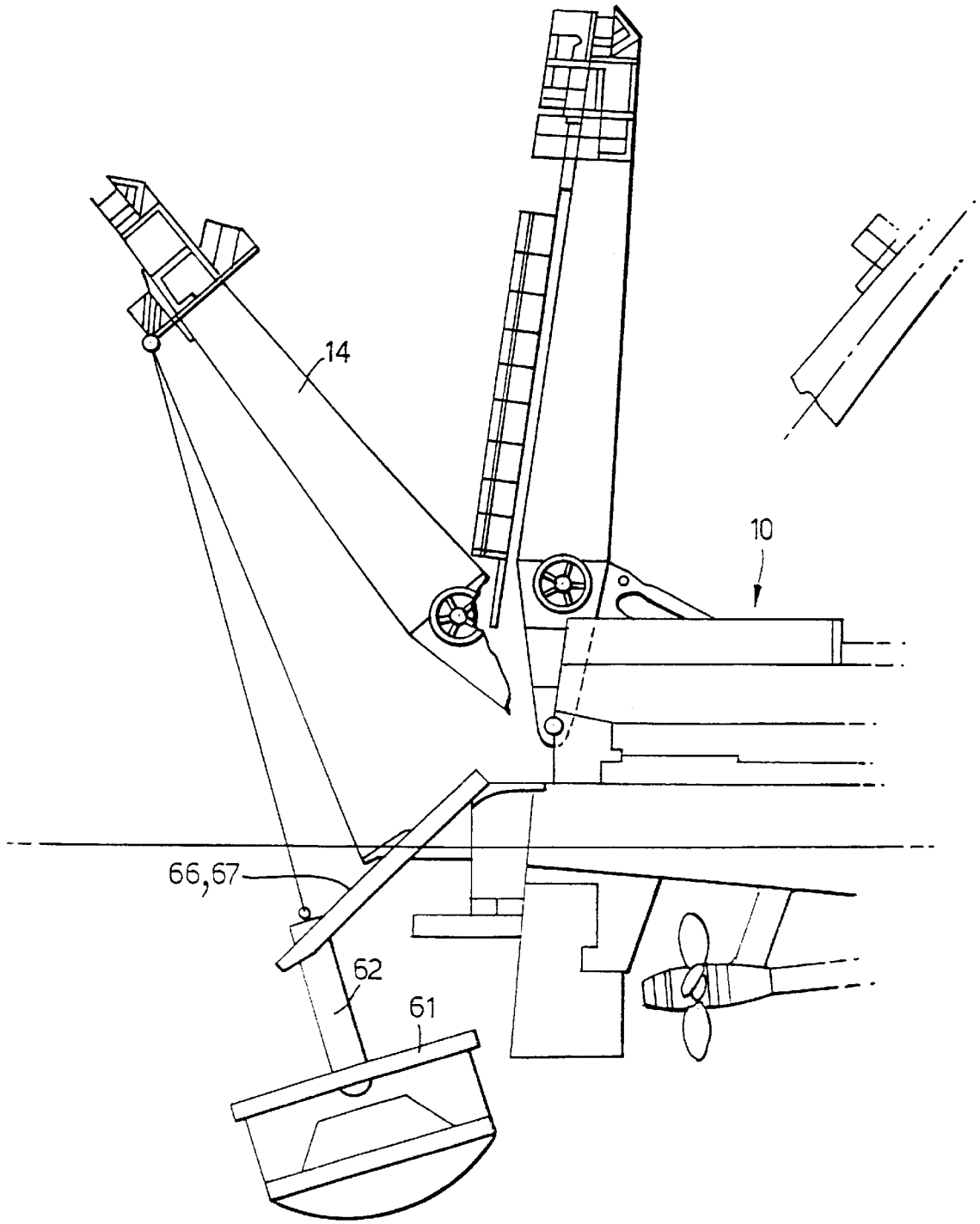
FIG. 11 shows a side view of the wing dredger of FIGS. 9 and 10 when attached to the support vessel.

We now refer to FIGS. 9, 10 and 11. It will be seen that the wing dredger 11 is mounted by means of the fore and aft points 48 to 51, by means of respective hydraulic rams 56 to 59 to rectangular frame 61 located above the wing dredger. This rectangular frame 61 (known as a spreader) includes a pulley block 62, a cable 63 passing from the pulley block 62 to the lifting means 14 on the support vessel 10 (to be further described with reference to FIG. 11).

It will understood, therefore, that to change the roll angle or pitch angle, in other words to change the attitude of the wing dredger 11 laterally or fore and aft, it is necessary to change the relative lengths of the hydraulic rams 56–59 accordingly. Thus, contraction of rams 56, 57 and/or extension of rams 58, 59 will lift end wall 17A with respect to their end wall 17B, contraction of rams 58, 59 and/or extension of rams 56, 57 will lift end wall 17B with respect to end wall 17A. Contraction of rams 56, 58 and/or extension of rams 57, 59 will lift the rear of the wing dredger with respect to its front, and contraction of rams 57, 59 and/or extension of rams 56, 58 will lift the front of the wing dredger with respect to the rear.

Referring now to FIG. 11, there is shown a wing dredger, rectangular frame (spreader) 61 and pulley block 62 of FIGS. 9 and 10 but attached to the lifting means 14 at the rear of the vessel 10. At the rear of the vessel 10 there are provided cantilever arms 66, 67 (which are primarily provided to keep the wing dredger away from the rear of the vessel), and the pulley block 62 and rectangular frame 61 are connected to the cantilever arms 66, 67. In this configuration, the wing dredger is mounted rigidly to the rear of the vessel and may be disposed at any desired transverse or fore to aft angle (any desired roll angle or pitch angle) for use in shallow water. In this configuration the wing dredger is effectively firmly fixed to the mother vessel and the mother vessel may be moved as desired so as to carry out whatever dredging operation is required.

The invention is not restricted to the details of the foregoing examples. Various methods of selectively varying the roll angle of the wing dredger will occur to an expert in the field.

What is claimed is:

1. A dredging apparatus comprising; a body having front and rear ends and opposite sides, a thruster mounted to said body to direct, in use, a wash of water downwards towards an area of seabed, connection structure to connect said dredging apparatus to a support vessel above the seabed, said body providing a face against which water flow caused by relative movement of the body and the water acts to provide a resultant downward component of force such that, in use, a weight of the body together with said resultant downward component of force provide a total downward force which exceeds an upward force provided by said thruster, said connection structure including adjustment means to selectively adjust the attitude of the dredging apparatus independently in a front to rear pitch orientation and a side to side roll orientation.

2. A dredging apparatus as claimed in claim 1 wherein said adjustment means to selectively adjust the attitude comprises at least three points on said body connected by flexible means to said support vessel, and a length adjuster being provided to independently vary a distance between the support vessel and each said point.

3. A dredging apparatus as claimed in claim 2 wherein said flexible means comprises an at least partially separate flexible means for each of said at least three points and said flexible means are connected to said support vessel by separate length adjusting means.

4. A dredging apparatus as claimed in claim 1 in which the body is in the form of a wing comprising a casing having ballast tanks to adjust the weight thereof, said casing also having at least one closed bore passing between upper and lower faces, in which said thruster is located.

5. A method of dredging in flowing water comprising the steps of: lowering a dredging apparatus comprising a body carrying a thruster so that the thruster is directed downwardly towards an area to be dredged, adjusting an orientation of the body in the water in a front to rear pitch orientation so that the body presents a surface relative to the flow which causes a resultant downward vertical component of force, operating said thruster to direct a wash of water towards the area, whereby turbulence created sets sand, silt and other material covering the area in suspension in the water so as to be carried away from the area by the flow of the water, and adjusting a roll orientation of the body in a side to side manner to cause the sand, silt and other material to be moved first to one side a subsequently to another side relative to the body.

6. The method of claim 5 including conveying the body through the water in a first direction with the body roll orientation being adjusted to direct the sand, silt and other material away from the one side of the body and thereafter reversing the direction of the body and adjusting the body roll orientation to direct sand, silt and other material away from an opposite side of the body.

* * * * *